US011674200B2

(12) United States Patent
Garcia-Avila et al.

(10) Patent No.: US 11,674,200 B2
(45) **Date of Patent: *Jun. 13, 2023**

(54) HIGH STRENGTH TITANIUM ALLOYS

(71) Applicant: ATI Properties LLC, Albany, OR (US)

(72) Inventors: Matias Garcia-Avila, Indian Trail, NC (US); John V. Mantione, Indian Trail, NC (US); Matthew J. Arnold, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 175 days.

This patent is subject to a terminal disclaimer.

(21) Appl. No.: 17/226,517

(22) Filed: Apr. 9, 2021

(65) Prior Publication Data

US 2022/0033935 A1 Feb. 3, 2022

Related U.S. Application Data

(63) Continuation of application No. 15/972,319, filed on May 7, 2018, now Pat. No. 11,001,909.

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 2,833,864 | A | 7/1959 | Harris et al. |
| 2,918,367 | A | 12/1959 | Crossley et al. |
| 3,131,059 | A | 4/1964 | Kaarlela |
| 3,565,591 | A | 2/1971 | Canonico et al. |
| 3,595,645 | A | 7/1971 | Hunter et al. |
| 3,756,810 | A | 9/1973 | Parris et al. |
| 3,833,363 | A | 9/1974 | Bomberger, Jr. et al. |
| 3,986,868 | A | 10/1976 | Crossley |
| 4,309,226 | A | 1/1982 | Chen |
| 4,738,822 | A | 4/1988 | Bania |
| 4,842,653 | A | 6/1989 | Wirth et al. |
| 4,889,170 | A | 12/1989 | Mae et al. |
| 5,472,526 | A | 12/1995 | Gigliotti, Jr. |
| 6,800,243 | B2 | 10/2004 | Tetyukhin et al. |
| 6,921,441 | B2 | 7/2005 | Tanaka et al. |
| 7,008,489 | B2 | 3/2006 | Bania |
| 7,083,687 | B2 | 8/2006 | Tanaka et al. |
| 8,454,768 | B2 | 6/2013 | Fanning |
| 9,399,806 | B2 | 7/2016 | Soniak et al. |
| 9,957,836 | B2 | 5/2018 | Sun et al. |
| 10,023,942 | B2 | 7/2018 | Schutz et al. |
| 10,913,991 | B2 | 2/2021 | Mantione et al. |
| 11,001,909 | B2 * | 5/2021 | Garcia-Avila ..... C22C 14/00 |
| 2008/0181808 | A1 | 7/2008 | Thamboo et al. |
| 2009/0180918 | A1 | 7/2009 | Tsai et al. |
| 2010/0326571 | A1 | 12/2010 | Deal et al. |
| 2016/0326612 | A1 | 11/2016 | Gudipati et al. |
| 2018/0200766 | A1 | 7/2018 | Kunieda et al. |
| 2019/0338397 | A1 | 11/2019 | Garcia-Avila et al. |
| 2020/0071806 | A1 | 3/2020 | Mantione et al. |
| 2020/0208241 | A1 | 7/2020 | Mantione et al. |
| 2022/0396860 | A1 | 12/2022 | Mantione et al. |
| 2023/0090733 | A1 | 3/2023 | Mantione et al. |

FOREIGN PATENT DOCUMENTS

| | | | |
|---|---|---|---|
| CA | 974095 | A1 | 9/1975 |
| CN | 1932058 | A | 3/2007 |
| CN | 1954087 | A | 4/2007 |
| CN | 101597703 | A | 12/2009 |
| CN | 101886189 | A | 11/2010 |
| CN | 103097560 | A | 5/2013 |
| CN | 104169449 | A | 11/2014 |
| CN | 105671366 | A | 6/2016 |
| EP | 0243056 | A1 | 10/1987 |
| EP | 1882752 | A2 | 1/2008 |

(Continued)

OTHER PUBLICATIONS

"Special Alloys and Forging Thereof," China Forging Association, pp. 119-122, National Defense Industry Press, Oct. 31, 2009.
"Metal Materials Science," Tang Daiming et al., pp. 251-252, Southwest Jiaotong University Press, Jun. 30, 2014.
"Engineering Materials and Metal Thermal Processing Basis," Jin Nanwei, p. 185, Aviation Industry Press, Jun. 30, 1995.
"Non-ferrous Metal Materials Science," Miao Qiang et al., p. 139, Northwestern Polytechnical University Press, Aug. 31, 2016.
ATI Ti—5Al—2Sn—2Zr—4Cr—4Mo Alloy Technical Datasheet (UNS R58650) ATI 17™, Version 1, Dec. 20, 2011, Allegheny Technologies Incorporated, 3 pages.
Crossley et al., "Cast Transage 175 Titanium Alloy for Durability Critical Structural Components", Journal of Aircraft, vol. 20, No. 1, Jan. 1983, pp. 66-69.

(Continued)

*Primary Examiner* — Jessee R Roe
(74) *Attorney, Agent, or Firm* — Robert J. Toth; K&L Gates LLP

(57) ABSTRACT

A non-limiting embodiment of a titanium alloy comprises, in weight percentages based on total alloy weight: 2.0 to 5.0 aluminum; 3.0 to 8.0 tin; 1.0 to 5.0 zirconium; 0 to a total of 16.0 of one or more elements selected from the group consisting of oxygen, vanadium, molybdenum, niobium, chromium, iron, copper, nitrogen, and carbon; titanium; and impurities. A non-limiting embodiment of the titanium alloy comprises an intentional addition of tin and zirconium in conjunction with certain other alloying additions such as aluminum, oxygen, vanadium, molybdenum, niobium, and iron, to stabilize the α phase and increase the volume fraction of the α phase without the risk of forming embrittling phases, which was observed to increase room temperature tensile strength while maintaining ductility.

31 Claims, 2 Drawing Sheets

(56) References Cited

FOREIGN PATENT DOCUMENTS

| | | | |
|---|---|---|---|
| GB | 888865 | | 2/1962 |
| JP | S62-267438 | A | 11/1987 |
| JP | H06-212378 | A | 8/1994 |
| JP | 2003-193159 | A | 7/2003 |
| JP | 2003-293051 | A | 10/2003 |
| JP | 2004-10963 | A | 1/2004 |
| JP | 2004-532785 | A | 10/2004 |
| JP | 2012-057200 | A | 3/2012 |
| JP | 2015-4100 | A | 1/2015 |
| JP | 2005-320570 | A | 11/2017 |
| RU | 1593259 | C | 11/1994 |
| RU | 2581332 | C2 | 4/2016 |
| RU | 2618016 | C2 | 5/2017 |
| RU | 2772375 | C2 | 5/2022 |
| SU | 524847 | A | 11/1976 |
| UA | 111002 | C2 | 3/2016 |
| WO | 2004/106569 | A1 | 12/2004 |
| WO | 2010/138886 | A1 | 12/2010 |
| WO | 2012/039929 | A1 | 3/2012 |
| WO | 2015/168131 | A1 | 11/2015 |
| WO | WO 2016/114956 | A1 | 7/2016 |
| WO | WO 2017/018511 | A1 | 2/2017 |
| WO | WO 2017/018514 | A1 | 2/2017 |

OTHER PUBLICATIONS

Inagaki et al., "Application and Features of Titanium for the Aerospace Industry", Nippon Steel & Sumitomo Metal Technical Report, No. 106, Jul. 2014, pp. 22-27.

Nyakana, "Quick reference guide for beta titanium alloys in the 00s", JMEPEG, vol. 14, 2015, pp. 799-811.

Cotton et al., "State of the Art in Beta Titanium Alloys for Airframe Applications", JOM, vol. 67, No. 6, 2015, pp. 1281-1303.

Lütjering et al., Titanium, 2nd edition, Springer, 2007, pp. 264-269.

Materials Properties Handbook: Titanium Alloys, eds. Boyer et al., Materials Park, Ohio, ASM International, 1994, 13 pages.

Kansal et al., "Microstructural Banding in Thermally and Mechanically Processed Titanium 6242", Journal of Material Engineering and Performance, Springer Verlag, New York, US, vol. 1, No. 3, Jun. 1, 1992, pp. 393-398.

Kitashima et al., "Microstructure and Creep Properties of Silicon- and/or Germanium-Bearing Near-[alpha] Titanium Alloys", Materials Science Forum, vol. 879, Nov. 15, 2015, pp. 2324-2329.

"Engineering Materials", Machinery Industry Press, edited by Zhan Wu, published Oct. 31, 1997, p. 226.

Murakami, Y., "Phase Transformation and Heat Treatment in Titanium Alloys", Tetsu-to-Hagané (Iron and Steel), Mar. 1, 1987, vol. 73, No. 3, p. 424. (untranslated).

English translation of p. 424, left column, line 22 to p. 425, left column, line 7 of Murakami, Y., "Phase Transformation and Heat Treatment in Titanium Alloys", Tetsu-to-Hagané (Iron and Steel), Mar. 1, 1987, vol. 73, No. 3, p. 424.

Shipsha, V.G., Titanium and Titanium Alloys, The Wayback Machine—https://web.archive.org/web/20180505165817/http://www.naukaspb.ru:80/spravochniki/Demo%20Metall/3_17.htm, accessed at http://www.naukaspb.ru/spravochniki/Demo%20Metall/3_17.htm, May 5, 2018, 27 pages.

Effect of impurities on titanium alloys, accessed at https://supersplav.ru/blog/2017/05/23/vliyanie-prim+A14esei-na-titanovye-splavy/, May 23, 2017, 8 pages.

Kitashima et al., "Effect of germanium and silicon additions on the mechanical properties of a near-α titanium alloy," Materials Science & Engineering A, Jan. 8, 2014, vol. 597, pp. 212-218.

U.S. Appl. No. 17/664,274, filed May 20, 2022, 30 pages.

* cited by examiner

HIGH STRENGTH TITANIUM ALLOYS

CROSS-REFERENCE TO RELATED APPLICATIONS

The present application claims priority under 35 U.S.C. § 120 as a continuation of co-pending U.S. application Ser. No. 15/972,319, now U.S. Pat. No. 11,001,909, filed May 7, 2018, the entire disclosure of which is hereby incorporated herein by reference.

BACKGROUND OF THE TECHNOLOGY

Field of the Technology

The present disclosure relates to high strength titanium alloys.

DESCRIPTION OF THE BACKGROUND OF THE TECHNOLOGY

Titanium alloys typically exhibit a high strength-to-weight ratio, are corrosion resistant, and are resistant to creep at moderately high temperatures. For these reasons, titanium alloys are used in aerospace and aeronautic applications including, for example, landing gear members, engine frames, and other critical structural parts. For example, Ti-10V-2Fe-3Al titanium alloy (also referred to as "Ti 10-2-3 alloy," having a composition specified in UNS 56410) and Ti-5Al-5Mo-5V-3Cr titanium alloy (also referred to as "Ti 5553 alloy"; UNS unassigned) are commercial alloys that are used for landing gear applications and other large components. These alloys exhibit an ultimate tensile strength in the 170-180 ksi range and are heat treatable in thick sections. However, these alloys tend to have limited ductility at room temperature in the high strength condition. This limited ductility is typically caused by embrittling phases such as $Ti_3Al$, TiAl, or omega phase.

In addition, Ti-10V-2Fe-3Al titanium alloy can be difficult to process. The alloy must be cooled quickly, such as by water or air quenching, after solution treatment in order to achieve the desired mechanical properties of the product, and this can limit its applicability to a section thickness of less than 3 inches (7.62 cm). The Ti-5Al-5Mo-5V-3Cr titanium alloy can be air cooled from solution temperature and, therefore, can be used in a section thickness of up to 6 inches (15.24 cm). However, its strength and ductility are lower than the Ti-10V-2Fe-3Al titanium alloy. Current alloys also exhibit limited ductility, for example less than 6%, in the high strength condition because of the precipitation of embrittling secondary metastable phases.

Accordingly, there has developed a need for titanium alloys with thick section hardenability and/or improved ductility at an ultimate tensile strength greater than about 170 ksi at room temperature.

SUMMARY

According to one non-limiting aspect of the present disclosure, a titanium alloy comprises, in weight percentages based on total alloy weight: 2.0 to 5.0 aluminum; 3.0 to 8.0 tin; 1.0 to 5.0 zirconium; 0 to a total of 16.0 of one or more elements selected from the group consisting of oxygen, vanadium, molybdenum, niobium, chromium, iron, copper, nitrogen, and carbon; titanium; and impurities.

According to another non-limiting aspect of the present disclosure, a titanium alloy comprises, in weight percentages based on total alloy weight: 8.6 to 11.4 of one or more elements selected from the group consisting of vanadium and niobium; 4.6 to 7.4 tin; 2.0 to 3.9 aluminum; 1.0 to 3.0 molybdenum; 1.6 to 3.4 zirconium; 0 to 0.5 chromium; 0 to 0.4 iron; 0 to 0.25 oxygen; 0 to 0.05 nitrogen; 0 to 0.05 carbon; titanium; and impurities.

According to yet another non-limiting aspect of the present disclosure, a titanium alloy consists essentially of, in weight percentages based on total alloy weight: 2.0 to 5.0 aluminum; 3.0 to 8.0 tin; 1.0 to 5.0 zirconium; 0 to a total of 16.0 of one or more elements selected from the group consisting of oxygen, vanadium, molybdenum, niobium, chromium, iron, copper, nitrogen, and carbon; titanium; and impurities.

BRIEF DESCRIPTION OF THE DRAWINGS

The features and advantages of alloys, articles, and methods described herein may be better understood by reference to the accompanying drawing in which.

Figure 1:
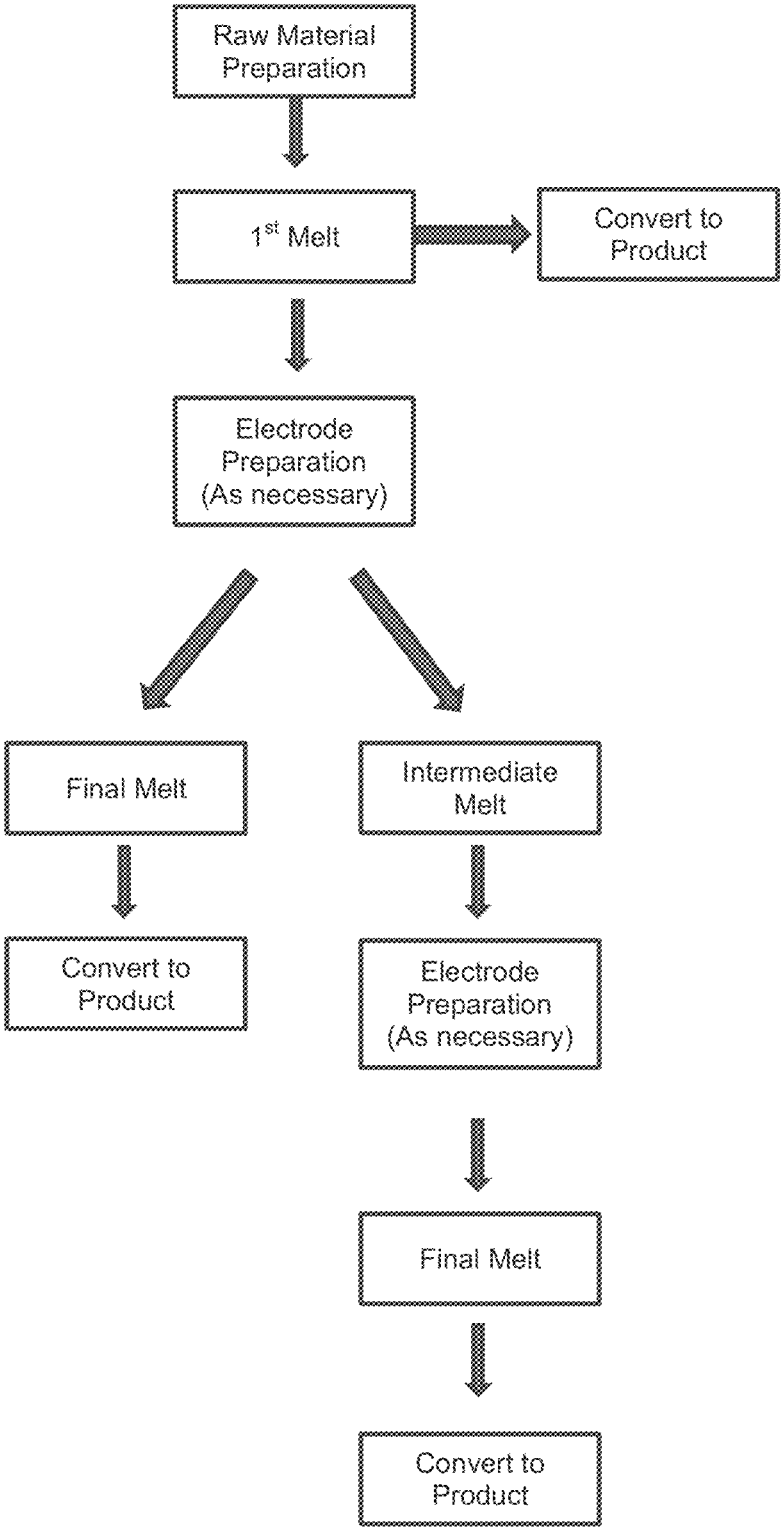
FIG. 1 is a plot illustrating a non-limiting embodiment of a method of processing a non-limiting embodiment of a titanium alloy according to the present disclosure.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the materials and by the methods according to the present disclosure. At the very least, and not as an attempt to limit the application of the doctrine of equivalents to the scope of the claims, each numerical parameter should at least be construed in light of the number of reported significant digits and by applying ordinary rounding techniques. All ranges described herein are inclusive of the described endpoints unless stated otherwise.

Any patent, publication, or other disclosure material that is said to be incorporated, in whole or in part, by reference herein is incorporated herein only to the extent that the incorporated material does not conflict with existing definitions, statements, or other disclosure material set forth in the present disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

As used herein, the term "ductility" or "ductility limit" refers to the limit or maximum amount of reduction or plastic deformation a metallic material can withstand without fracturing or cracking. This definition is consistent with the meaning ascribed in, for example, ASM Materials Engineering Dictionary, J. R. Davis, ed., ASM International (1992), p. 131.

Reference herein to a titanium alloy "comprising" a particular composition is intended to encompass alloys "consisting essentially of" or "consisting of" the stated composition. It will be understood that titanium alloy compositions described herein "comprising", "consisting of", or "consisting essentially of" a particular composition also may include impurities.

The present disclosure, in part, is directed to alloys that address certain of the limitations of conventional titanium alloys. One non-limiting embodiment of the titanium alloy according to the present disclosure may comprise or consist essentially of, in weight percentages based on total alloy weight: 2.0 to 5.0 aluminum; 3.0 to 8.0 tin; 1.0 to 5.0 zirconium; 0 to a total of 16.0 of one or more elements selected from oxygen, vanadium, molybdenum, niobium, chromium, iron, copper, nitrogen, and carbon; titanium; and impurities. Certain embodiments of that titanium alloy may further comprise or consist essentially of, in weight percentages based on total alloy weight: 6.0 to 12.0, or in some embodiments 6.0 to 10.0, of one or more elements selected from the group consisting of vanadium and niobium; 0.1 to 5.0 molybdenum; 0.01 to 0.40 iron; 0.005 to 0.3 oxygen; 0.001 to 0.07 carbon; and 0.001 to 0.03 nitrogen. Another non-limiting embodiment of the titanium alloy according to the present disclosure may comprise or consist essentially of, in weight percentages based on total alloy weight: 8.6 to 11.4 of one or more elements selected from the group consisting of vanadium and niobium; 4.6 to 7.4 tin; 2.0 to 3.9 aluminum; 1.0 to 3.0 molybdenum; 1.6 to 3.4 zirconium; 0 to 0.5 chromium; 0 to 0.4 iron; 0 to 0.25 oxygen; 0 to 0.05 nitrogen; 0 to 0.05 carbon; titanium; and impurities.

In non-limiting embodiments of alloys according to this disclosure, incidental elements and impurities in the alloy composition may comprise or consist essentially of one or more of hydrogen, tungsten, tantalum, manganese, nickel, hafnium, gallium, antimony, silicon, sulfur, potassium, and cobalt. Certain non-limiting embodiments of titanium alloys according to the present disclosure may comprise, in weight percentages based on total alloy weight, 0 to 0.015 hydrogen, and 0 up to 0.1 of each of tungsten, tantalum, manganese, nickel, hafnium, gallium, antimony, silicon, sulfur, potassium, and cobalt.

In certain non-limiting embodiments of the present titanium alloy, the titanium alloy comprises an aluminum equivalent value of 6.0 to 9.0 and a molybdenum equivalent value of 5.0 to 10.0, which the inventers have observed improves ductility at an ultimate tensile strength greater than about 170 ksi at room temperature while avoiding undesirable phases, accelerating precipitation kinetics, and promoting a martensitic transformation during processing. As used herein, "aluminum equivalent value" or "aluminum equivalent" ($Al_{eq}$) may be determined as follows (wherein all elemental concentrations are in weight percentages, as indicated): $Al_{eq}=+[(1/6)\times Zr_{(wt\ \%)}]+[(1/3)\times Sn_{(wt\ \%)}]+[10\times O_{(wt\ \%)}]$. As used herein, "molybdenum equivalent value" or "molybdenum equivalent" ($Mo_{eq}$) may be determined as follows (wherein all elemental concentrations are in weight percentages, as indicated): $Mo_{eq}=Mo_{(wt.\ \%)}+[(1/5)\times Ta_{(wt\ \%)}]+[(1/3.6)\times Nb_{(wt.\ \%)}]+[(1/2.5)\times W_{(wt.\ \%)}]+[(1/1.5)\times V_{(wt.\ \%)}]+[1.25\times Cr_{(wt\ \%)}]+[1.25\times Ni_{(wt\ \%)}]+[1.7\times Mn_{(wt\ \%)}]+[1.7\times Co_{(wt\ \%)}]+[2.5\times Fe_{(wt\ \%)}]$.

In certain non-limiting embodiments of the present titanium alloy, the titanium alloy comprises a relatively low aluminum content to prevent the formation of brittle intermetallic phases of $Ti_3X$-type, where X represents a metal. Titanium has two allotropic forms: a beta ("β")-phase, which has a body centered cubic ("bcc") crystal structure; and an alpha ("α")-phase, which has a hexagonal close packed ("hcp") crystal structure. Most α-β titanium alloys contain approximately 6% aluminum, which can form $Ti_3Al$ upon heat treatment. This can have a deleterious effect on ductility. Accordingly, certain embodiments of the titanium alloys according to the present disclosure include about 2.0% to about 5.0% aluminum, by weight. In certain other embodiments of the titanium alloys according to the present disclosure, the aluminum content is about 2.0% to about 3.4%, by weight. In further embodiments, the aluminum content of titanium alloys according to the present disclosure may be about 3.0% to about 3.9%, by weight.

In certain non-limiting embodiments of the present titanium alloy, the titanium alloy comprises an intentional addition of tin and zirconium in conjunction with certain other alloying additions such as aluminum, oxygen, vanadium, molybdenum, niobium, and iron. Without intending to be bound to any theory, it is believed that the intentional addition of tin and zirconium stabilizes the α phase, increasing the volume fraction of the a phase without the risk of forming embrittling phases. It was observed that the intentional addition of tin and zirconium increases room temperature tensile strength while maintaining ductility. The addition of tin and zirconium also provides solid solution strengthening in both the α and β phases. In certain embodiments of the titanium alloys according to the present disclosure, a sum of aluminum, tin, and zirconium contents is 8% to 15% by weight based on total alloy weight.

In certain non-limiting embodiments according to the present disclosure, the titanium alloys disclosed herein include one or more β-stabilizing elements selected from vanadium, molybdenum, niobium, iron, and chromium to slow the precipitation and growth of a phase while cooling the material from the β phase field, and achieve the desired thick section hardenability. Certain embodiments of titanium alloys according to the present disclosure comprise about 6.0% to about 12.0% of one or more elements selected from the group consisting of vanadium and niobium, by weight. In further embodiments, a sum of vanadium and niobium contents in the titanium alloys according to the present disclosure may be about 8.6% to about 11.4%, about 8.6% to about 9.4%, or about 10.6% to about 11.4%, all in weight percentages based on total weight of the titanium alloy.

A first non-limiting titanium alloy according to the present disclosure comprises or consists essentially of, in weight percentages based on total alloy weight: 2.0 to 5.0 aluminum; 3.0 to 8.0 tin; 1.0 to 5.0 zirconium; 0 to a total of 16.0 of one or more elements selected from oxygen, vanadium, molybdenum, niobium, chromium, iron, copper, nitrogen, and carbon; titanium; and impurities.

In the first embodiment, aluminum may be included for stabilization of alpha phase and strengthening. In the first embodiment, aluminum may be present in any concentration in the range of 2.0 to 5.0 weight percent, based on total alloy weight.

In the first embodiment, tin may be included for solid solution strengthening of the alloy and stabilization of alpha phase. In the first embodiment, tin may be present in any concentration in the range of 3.0 to 8.0 weight percent, based on total alloy weight.

In the first embodiment, zirconium may be included for solid solution strengthening of the alloy and stabilization of alpha phase. In the first embodiment, zirconium may be present in any concentration in the range of 1.0 to 5.0 weight percent, based on total alloy weight.

In the first embodiment, molybdenum, if present, may be included for solid solution strengthening of the alloy and stabilization of beta phase. In the first embodiment, molybdenum may be present in any of the following weight concentration ranges, based on total alloy weight: 0 to 5.0; 1.0 to 5.0; 1.0 to 3.0; 1.0 to 2.0; and 2.0 to 3.0.

In the first embodiment, iron, if present, may be included for solid solution strengthening of the alloy and stabilization of beta phase. In the first embodiment, iron may be present in any of the following weight concentration ranges, based on total alloy weight: 0 to 0.4; and 0.01 to 0.4.

In the first embodiment, chromium, if present, may be included for solution strengthening of the alloy and stabilization of beta phase. In the first embodiment, chromium may be present in any concentration within the range of 0 to 0.5 weight percent, based on total alloy weight.

A second non-limiting titanium alloy according to the present disclosure comprises or consists essentially of, in weight percentages based on total alloy weight: 8.6 to 11.4 of one or more elements selected from the group consisting of vanadium and niobium; 4.6 to 7.4 tin; 2.0 to 3.9 aluminum; 1.0 to 3.0 molybdenum; 1.6 to 3.4 zirconium; 0 to 0.5 chromium; 0 to 0.4 iron; 0 to 0.25 oxygen; 0 to 0.05 nitrogen; 0 to 0.05 carbon; titanium; and impurities.

In the second embodiment, vanadium and/or niobium may be included for solution strengthening of the alloy and stabilization of beta phase. In the second embodiment, the total combined content of vanadium and niobium aluminum may be any concentration in the range of 8.6 to 11.4 weight percent, based on total alloy weight.

Without intending to be bound to any theory, it is believed that a greater aluminum equivalent value may stabilize the α phase of the alloys herein. On the other hand, a greater molybdenum equivalent value may stabilize the 13 phase. In certain embodiments of the titanium alloys according to the present disclosure, a ratio of the aluminum equivalent value to the molybdenum equivalent value is 0.6 to 1.3 to allow for strengthening of the alloy, reducing the risk of formation of embrittling phases, allowing good forgeability and formation of ultrafine microstructure which provide good high cycle fatigue properties.

The nominal production method for the high strength titanium alloys according to the present disclosure is typical for cast-wrought titanium and titanium alloys and will be familiar to those skilled in the art. A general process flow for alloy production is provided in FIG. 1 and described as follows. It should be noted that this description does not limit the alloy to be cast-wrought. The alloys according to the present disclosure, for example, may also be produced by powder-to-part production methods, which may include consolidation and/or additive manufacturing methods.

In certain non-limiting embodiments according to the present disclosure, the raw materials to be used in producing the alloy are prepared. According to certain non-limiting embodiments, the raw materials may include, but are not be limited to, titanium sponge or powder, elemental additions, master alloys, titanium dioxide, and recycle material. Recycle material, also known as revert or scrap, may consist of or include titanium and titanium alloy turnings or chips, small and/or large solids, powder, and other forms of titanium or titanium alloys previously generated and re-processed for re-use. The form, size, and shape of the raw material to be used may depend on the methods used to melt the alloy. According to certain non-limiting embodiments, the material may be in the form of a particulate and introduced loose into a melt furnace. According to other embodiments, some or all of the raw material may be compacted into small or large briquettes. Depending on the requirements or preferences of the particular melt method, the raw material may be assembled into a consumable electrode for melting or may be fed as a particulate into the furnace. The raw material processed by the cast-wrought process may be single or multiple melted to a final ingot product. According to certain non-limiting embodiments, the ingot may be cylindrical in shape. In other embodiments, however, the ingot may assume any geometric form, including, but not limited to, ingots having a rectangular or other cross section.

According to certain non-limiting embodiments, the melt methods for production of an alloy via a cast-wrought route may include plasma cold hearth (PAM) or electron beam cold hearth (EB) melting, vacuum arc remelting (VAR), electro-slag remelting (ESR or ESRR), and/or skull melting. A non-limiting listing of methods for the production of powder includes induction melted/gas atomized, plasma atomized, plasma rotating electrode, electrode induction gas atomized, or one of the direct reduction techniques from $TiO_2$ or $TiCl_4$.

According to certain non-limiting embodiments, the raw material may be melted to form one or more first melt electrode(s). The electrode(s) are prepared and remelted one or more times, typically using VAR, to produce a final melt ingot. For example, the raw material may be plasma arc cold hearth melted (PAM) to create a 26 inch diameter cylindrical electrode. The PAM electrode may then be prepared and subsequently vacuum arc remelted (VAR) to a 30 inch diameter final melt ingot having a typical weight of approximately 20,000 lb. The final melt ingot of the alloy is then converted by wrought processing means to the desired product, which can be, for example, wire, bar, billet, sheet, plate, and products having other shapes. The products can be produced in the final form in which the alloy is utilized, or can be produced in an intermediate form that is further processed to a final component by one or more techniques that may include, for example, forging, rolling, drawing, extruding, heat treatment, machining, and welding.

According to certain non-limiting embodiments, the wrought conversion of titanium and titanium alloy ingots typically involves an initial hot forging cycle utilizing an open die forging press. This part of the process is designed to take the as-cast internal grain structure of the ingot and reduce it to a more refined size, which may suitably exhibit desired alloy properties. The ingot may be heated to an elevated temperature, for example above the β-transus of the alloy, and held for a period of time. The temperature and time are established to permit the alloy to fully reach the desired temperature and may be extended for longer times to homogenize the chemistry of the alloy. The alloy may then be forged to a smaller size by a combination of upset and/or draw operations. The material may be sequentially forged and reheated, with reheat cycles including, for example, one or a combination of heating steps at temperatures above and/or below the β-transus. Subsequent forging cycles may be performed on an open die forging press, rotary forge, rolling mill, and/or other similar equipment used to deform metal alloys to a desired size and shape at elevated temperature. Those skilled in the art will be familiar with a variety of sequences of forging steps and temperature cycles to obtain a desired alloy size, shape, and internal grain structure. For example, one such method for processing is provided in U.S. Pat. No. 7,611,592, which is incorporated by reference herein in its entirety.

A non-limiting embodiment of a method of making a titanium alloy according to the present disclosure comprises final forging in either the α-β or β phase field, and subsequently heat treating by annealing, solution treating and annealing, solution treating and aging (STA), direct aging, or a combination of thermal cycles to obtain the desired balance of mechanical properties. In certain possible non-limiting embodiments, titanium alloys according to the present disclosure exhibit improved workability at a given temperature, as compared to other conventional high strength alloys. This feature permits the alloy to be processed by hot working in both the α-β and the β phase fields with less cracking or other detrimental effects, thereby improving yield and reducing product costs.

As used herein, a "solution treating and aging" or "STA" process refers to a heat treating process applied to titanium alloys that includes solution treating a titanium alloy at a solution treating temperature below the β-transus temperature of the titanium alloy. In a non-limiting embodiment, the solution treating temperature is in a temperature range from about 760° C. to 840° C. In other embodiments, the solution treating temperature may shift with the β-transus. For example, the solution treating temperature may be in a temperature range from β-transus minus 10° C. to β-transus minus 100° C., or β-transus minus 15° C. to β-transus minus 70° C. In a non-limiting embodiment, a solution treatment time ranges from about 30 minutes to about 4 hours. It is recognized that in certain non-limiting embodiments, the solution treatment time may be shorter than 30 minutes or longer than 4 hours and is generally dependent on the size and cross-section of the titanium alloy. In certain embodiments according to the present disclosure, the titanium alloy is water quenched to ambient temperature upon completion of the solution treatment. In certain other embodiments according to the present disclosure, the titanium alloy is cooled to ambient temperature at a rate depending on a cross-sectional thickness of the titanium alloy.

The solution treated alloy is subsequently aged by heating the alloy for a period of time to an aging temperature, also referred to herein as an "age hardening temperature", that is in the α+β two-phase field, below the β transus temperature of the titanium alloy and less than the solution treating temperature of the titanium alloy. As used herein, terms such as "heated to" or "heating to", etc., with reference to a temperature, a temperature range, or a minimum temperature, mean that the alloy is heated until at least the desired portion of the alloy has a temperature at least equal to the referenced or minimum temperature, or within the referenced temperature range throughout the portion's extent. In a non-limiting embodiment, the aging temperature is in a temperature range from about 482° C. to about 593° C. In certain non-limiting embodiments, the aging time may range from about 30 minutes to about 16 hours. It is recognized that in certain non-limiting embodiments, the aging time may be shorter than 30 minutes or longer than 16 hours, and is generally dependent on the size and cross-section of the titanium alloy product form. General techniques used in solution treating and aging (STA) processing of titanium alloys are known to practitioners of ordinary skill in the art and, therefore, are not further discussed herein.

Figure 2:
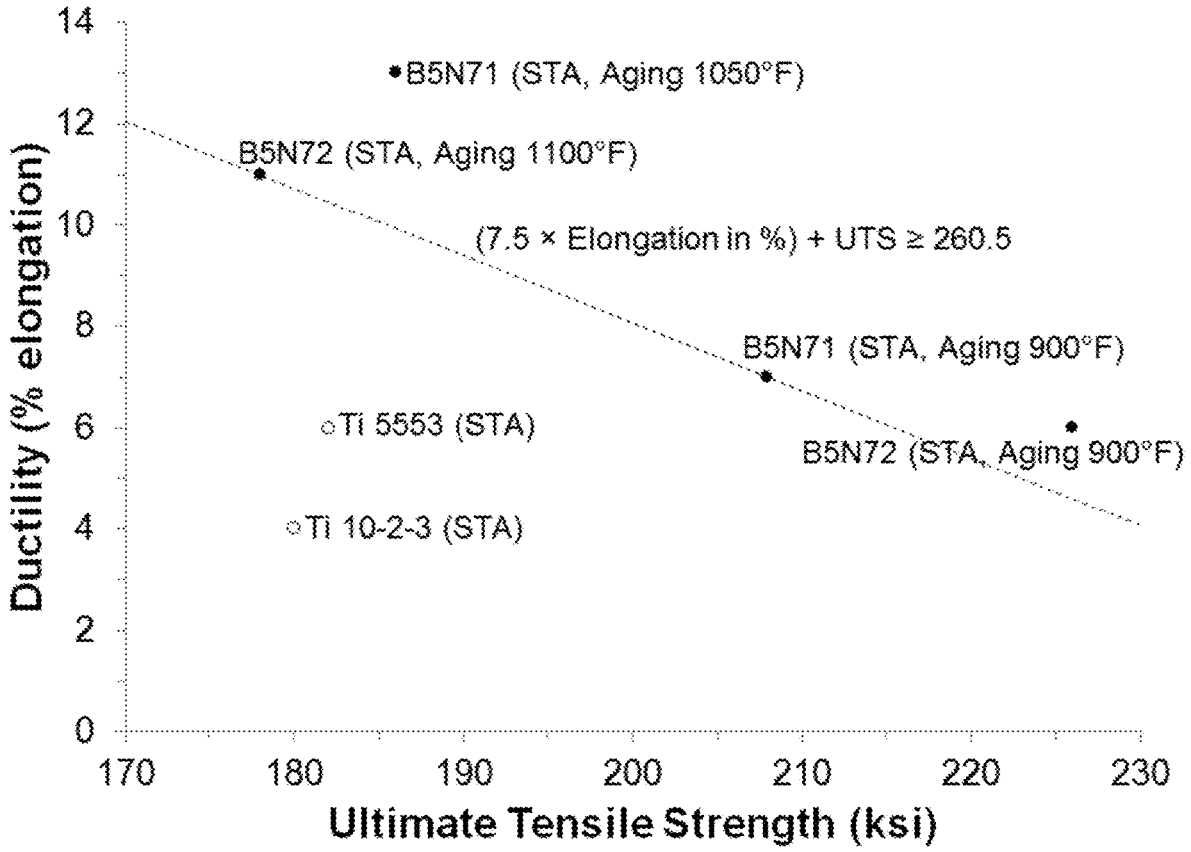
FIG. 2 is a graph plotting ultimate tensile strength (UTS) and elongation of non-limiting embodiments of titanium alloys according to the present disclosure in comparison to certain conventional titanium alloys.

FIG. 2 is a graph presenting the useful combinations of ultimate tensile strength (UTS) and ductility exhibited by the aforementioned alloys when processed using the STA process. It is seen in FIG. 2 that a lower boundary of the plot including useful combinations of UTS and ductility can be approximated by the line x+7.5y=260.5, where "x" is UTS in units of ksi and "y" is ductility in % elongation. Data included in Example 1 presented herein below demonstrate that embodiments of titanium alloys according to the present disclosure result in combinations of UTS and ductility that exceed those obtained with certain prior art alloys. While it is recognized that the mechanical properties of titanium alloys are generally influenced by the size of the specimen being tested, in non-limiting embodiments according to the present disclosure, a titanium alloy exhibits a UTS of at least 170 ksi and ductility according to the following Equation (1):

$$(7.5\times\text{Elongation in }\%)+(\text{UTS in ksi})\geq 260.5 \quad (1)$$

In certain non-limiting embodiments of the present titanium alloy, the titanium alloy exhibits a UTS of at least 170 ksi and at least 6% elongation at room temperature. In other non-limiting embodiments according to the present disclosure, a titanium alloy comprises an aluminum equivalent value of 6.0 to 9.0, or in certain embodiments within the range of 7.0 to 8.0, a molybdenum equivalent value of 5.0 to 10.0, or in certain embodiments within the range of 6.0 to 7.0, and exhibits a UTS of at least 170 ksi and at least 6% elongation at room temperature. In yet other non-limiting embodiments, a titanium alloy according to the present disclosure comprises an aluminum equivalent value of 6.0 to 9.0, or in certain embodiments within the range of 7.0 to 8.0, a molybdenum equivalent value of 5.0 to 10.0, or in certain embodiments within the range of 6.0 to 7.0, and exhibits a UTS of at least 180 ksi and at least 6% elongation at room temperature.

The examples that follow are intended to further describe non-limiting embodiments according to the present disclosure, without restricting the scope of the present invention. Persons having ordinary skill in the art will appreciate that variations of the following examples are possible within the scope of the invention, which is defined solely by the claims.

Example 1

Table 1 list elemental compositions, $Al_{eq}$, and $Mo_{eq}$ of certain non-limiting embodiments of a titanium alloy according to the present disclosure ("Experimental Titanium Alloy No. 1" and "Experimental Titanium Alloy No. 2"), and embodiments of certain conventional titanium alloys.

TABLE 1

| Alloy | Al (wt %) | V (wt %) | Fe (wt %) | Sn (wt %) | Cr (wt %) | Zr (wt %) | Mo (wt %) | O (wt %) | C (wt %) | N (wt %) | Al-Eq | Mo-Eq |
|---|---|---|---|---|---|---|---|---|---|---|---|---|
| Ti 5553 (UNS unassigned) | 5 | 5 | 0.4 | — | 3 | — | 5 | 0.15 | — | — | 6.5 | 11.8 |
| Ti 10-2-3 (UNS 56410) | 3 | 10 | 2 | — | — | — | — | 0.2 | — | — | 5.0 | 9.0 |

TABLE 1-continued

| Alloy | Al (wt %) | V (wt %) | Fe (wt %) | Sn (wt %) | Cr (wt %) | Zr (wt %) | Mo (wt %) | O (wt %) | C (wt %) | N (wt %) | Al-Eq | Mo-Eq |
|---|---|---|---|---|---|---|---|---|---|---|---|---|
| Experimental Titanium Alloy No. 1 | 3.5 | 9 | 0.2 | 5 | <0.5 | 3 | 2.5 | 0.25 | 0.006 | 0.004 | 7.7 | 6.6 |
| Experimental Titanium Alloy No. 2 | 3 | 11 | 0.2 | 7 | <0.5 | 2 | 1.5 | 0.2 | 0.006 | 0.004 | 7.3 | 6.4 |

Plasma arc melt (PAM) heats of the Experimental Titanium Alloy No. 1 and Experimental Titanium Alloy No. 2 listed in Table 1 were produced using plasma arc furnaces to produce 9 inch diameter electrodes, each weighing approximately 400-800 lb. The electrodes were remelted in a vacuum arc remelt (VAR) furnace to produce 10 inch diameter ingots. Each ingot was converted to a 3 inch diameter billet using a hot working press. After a β forging step to 7 inch diameter, an α+β prestrain forging step to 5 inch diameter, and a β finish forging step to 3 inch diameter, the ends of each billet were cropped to remove suck-in and end-cracks, and the billets were cut into multiple pieces. The top of each billet and the bottom of the bottom-most billet at 7 inch diameter were sampled for chemistry and β transus. Based on the intermediate billet chemistry results, 2 inch long samples were cut from the billets and "pancake"-forged on the press. The pancake specimens were heat treated using the following heat treatment profile, corresponding to a solution treated and aged condition: solution treating the titanium alloy at a temperature of 1400° F. (760° C.) for 2 hours; air cooling the titanium alloy to ambient temperature; aging the titanium alloy at about 482° C. to about 593° C. for 8 hours; and air cooling the titanium alloy.

Test blanks for room and tensile tests and microstructure analysis were cut from the STA processed pancake specimens. A final chemistry analysis was performed on the fracture toughness coupon after testing to ensure accurate correlation between chemistry and mechanical properties. Examination of the final 3 inch diameter billet revealed a consistent surface to center fine alpha laths in a beta matrix microstructure through the billet.

Referring to FIG. 2, mechanical properties of Experimental Titanium Alloy No. 1 listed in Table 1 (denoted "B5N71" in FIG. 2) and Experimental Titanium Alloy No. 2 listed in Table 1 (denoted "B5N72" in FIG. 2) were measured and compared to those of conventional Ti 5553 alloy (UNS unassigned) and Ti 10-2-3 alloy (having a composition specified in UNS 56410). Tensile tests were conducted according to the American Society for Testing and Materials (ASTM) standard E8/E8M-09 ("Standard Test Methods for Tension Testing of Metallic Materials", ASTM International, 2009). As shown by the experimental results in Table 2, Experimental Titanium Alloy No. 1 and Experimental Titanium Alloy No. 2 exhibited significantly greater combinations of ultimate tensile strength, yield strength, and ductility (reported as % elongation) relative to conventional Ti 5553 and Ti 10-2-3 titanium alloys (which did not include an intentional addition of tin and zirconium).

TABLE 2

| Alloy | Aging Temperature (° C.) | UTS (ksi) | 0.2% YS (ksi) | % Elong. |
|---|---|---|---|---|
| Ti 5553 | 565 | 180 | 170 | 4 |
| Ti 10-2-3 | 500 | 182 | 172 | 6 |

TABLE 2-continued

| Alloy | Aging Temperature (° C.) | UTS (ksi) | 0.2% YS (ksi) | % Elong. |
|---|---|---|---|---|
| Experimental Titanium | 565 | 186 | 180 | 13 |
| Alloy No. 1 | 482 | 208 | 195 | 7 |
| Experimental Titanium | 593 | 178 | 167 | 11 |
| Alloy No. 2 | 482 | 226 | 215 | 6 |

The potential uses of alloys according to the present disclosure are numerous. As described and evidenced above, the titanium alloys described herein are advantageously used in a variety of applications in which a combination of high strength and ductility is important. Articles of manufacture for which the titanium alloys according to the present disclosure would be particularly advantageous include certain aerospace and aeronautical applications including, for example, landing gear members, engine frames, and other critical structural parts. Those having ordinary skill in the art will be capable of fabricating the foregoing equipment, parts, and other articles of manufacture from alloys according to the present disclosure without the need to provide further description herein. The foregoing examples of possible applications for alloys according to the present disclosure are offered by way of example only, and are not exhaustive of all applications in which the present alloy product forms may be applied. Those having ordinary skill, upon reading the present disclosure, may readily identify additional applications for the alloys as described herein.

Various non-exhaustive, non-limiting aspects of novel alloys according to the present disclosure may be useful alone or in combination with one or more other aspects described herein. Without limiting the foregoing description, in a first non-limiting aspect of the present disclosure, a titanium alloy comprises, in weight percentages based on total alloy weight: 2.0 to 5.0 aluminum; 3.0 to 8.0 tin; 1.0 to 5.0 zirconium; 0 to a total of 16.0 of one or more elements selected from the group consisting of oxygen, vanadium, molybdenum, niobium, chromium, iron, copper, nitrogen, and carbon; titanium; and impurities.

In accordance with a second non-limiting aspect of the present disclosure, which may be used in combination with the first aspect, the titanium alloy comprises, in weight percentages based on total alloy weight, 6.0 to 12.0 of one or more elements selected from the group consisting of vanadium and niobium.

In accordance with a third non-limiting aspect of the present disclosure, which may be used in combination with each or any of the above-mentioned aspects, the titanium alloy comprises, in weight percentages based on total alloy weight, 0.1 to 5.0 molybdenum.

In accordance with a fourth non-limiting aspect of the present disclosure, which may be used in combination with each or any of the above-mentioned aspects, the titanium alloy has an aluminum equivalent value of 6.0 to 9.0.

In accordance with a fifth non-limiting aspect of the present disclosure, which may be used in combination with each or any of the above-mentioned aspects, the titanium alloy has a molybdenum equivalent value of 5.0 to 10.0.

In accordance with a sixth non-limiting aspect of the present disclosure, which may be used in combination with each or any of the above-mentioned aspects, the titanium alloy has an aluminum equivalent value of 6.0 to 9.0 and a molybdenum equivalent value of 5.0 to 10.0.

In accordance with a seventh non-limiting aspect of the present disclosure, which may be used in combination with each or any of the above-mentioned aspects, the titanium alloy comprises, in weight percentages based on total alloy weight: 6.0 to 12.0, or in some embodiments 6.0 to 10.0, of one or more elements selected from the group consisting of vanadium and niobium; 0.1 to 5.0 molybdenum; 0.01 to 0.40 iron; 0.005 to 0.3 oxygen; 0.001 to 0.07 carbon; and 0.001 to 0.03 nitrogen.

In accordance with an eighth non-limiting aspect of the present disclosure, which may be used in combination with each or any of the above-mentioned aspects, a sum of aluminum, tin, and zirconium contents is, in weight percentages based on the total alloy weight, 8 to 15.

In accordance with a ninth non-limiting aspect of the present disclosure, which may be used in combination with each or any of the above-mentioned aspects, a ratio of the aluminum equivalent value to the molybdenum equivalent value is 0.6 to 1.3.

In accordance with a tenth non-limiting aspect of the present disclosure, a method of making a titanium alloy comprises: solution treating a titanium alloy at 760° C. to 840° C. for 1 to 4 hours; air cooling the titanium alloy to ambient temperature; aging the titanium alloy at 482° C. to 593° C. for 8 to 16 hours; and air cooling the titanium alloy, wherein the titanium alloy has the composition recited in each or any of the above-mentioned aspects.

In accordance with an eleventh non-limiting aspect of the present disclosure, which may be used in combination with each or any of the above-mentioned aspects, the titanium alloy exhibits an ultimate tensile strength (UTS) of at least 170 ksi at room temperature, and wherein the ultimate tensile strength and an elongation of the titanium alloy satisfy the equation: (7.5×Elongation in %)+UTS≥260.5.

In accordance with a twelfth non-limiting aspect of the present disclosure, the present disclosure also provides a titanium alloy comprising, in weight percentages based on total alloy weight: 8.6 to 11.4 of one or more elements selected from the group consisting of vanadium and niobium; 4.6 to 7.4 tin; 2.0 to 3.9 aluminum; 1.0 to 3.0 molybdenum; 1.6 to 3.4 zirconium; 0 to 0.5 chromium; 0 to 0.4 iron; 0 to 0.25 oxygen; 0 to 0.05 nitrogen; 0 to 0.05 carbon; titanium; and impurities.

In accordance with a thirteenth non-limiting aspect of the present disclosure, which may be used in combination with each or any of the above-mentioned aspects, the titanium alloy comprises, in weight percentages based on total alloy weight, 8.6 to 9.4 of one or more elements selected from the group consisting of vanadium and niobium.

In accordance with a fourteenth non-limiting aspect of the present disclosure, which may be used in combination with each or any of the above-mentioned aspects, the titanium alloy comprises, in weight percentages based on total alloy weight, 10.6 to 11.4 of one or more elements selected from the group consisting of vanadium and niobium.

In accordance with a fifteenth non-limiting aspect of the present disclosure, which may be used in combination with each or any of the above-mentioned aspects, the titanium alloy further comprises, in weight percentages based on total alloy weight, 2.0 to 3.0 molybdenum.

In accordance with a sixteenth non-limiting aspect of the present disclosure, which may be used in combination with each or any of the above-mentioned aspects, the titanium alloy comprises, in weight percentages based on total alloy weight, 1.0 to 2.0 molybdenum.

In accordance with a seventeenth non-limiting aspect of the present disclosure, which may be used in combination with each or any of the above-mentioned aspects, the titanium alloy has an aluminum equivalent value of 7.0 to 8.0.

In accordance with an eighteenth non-limiting aspect of the present disclosure, which may be used in combination with each or any of the above-mentioned aspects, the titanium alloy has a molybdenum equivalent value of 6.0 to 7.0.

In accordance with a nineteenth non-limiting aspect of the present disclosure, which may be used in combination with each or any of the above-mentioned aspects, the titanium alloy has an aluminum equivalent value of 7.0 to 8.0 and a molybdenum equivalent value of 6.0 to 7.0.

In accordance with a twentieth non-limiting aspect of the present disclosure, which may be used in combination with each or any of the above-mentioned aspects, the titanium alloy comprises, in weight percentages based on total alloy weight: 8.6 to 9.4 of one or more elements selected from the group consisting of vanadium and niobium; 4.6 to 5.4 tin; 3.0 to 3.9 aluminum; 2.0 to 3.0 molybdenum; and 2.6 to 3.4 zirconium.

In accordance with a twenty-first non-limiting aspect of the present disclosure, which may be used in combination with each or any of the above-mentioned aspects, the titanium alloy comprises, in weight percentages based on total alloy weight: 10.6 to 11.4 of one or more elements selected from the group consisting of vanadium and niobium; 6.6 to 7.4 tin; 2.0 to 3.4 aluminum; 1.0 to 2.0 molybdenum; and 1.6 to 2.4 zirconium.

In accordance with a twenty-second non-limiting aspect of the present disclosure, a method of making a titanium alloy comprises: solution treating a titanium alloy at 760° C. to 840° C. for 2 to 4 hours; air cooling the titanium alloy to ambient temperature; aging the titanium alloy at 482° C. to 593° C. for 8 to 16 hours; and air cooling the titanium alloy, wherein the titanium alloy has the composition recited in each or any of the above-mentioned aspects.

In accordance with a twenty-third non-limiting aspect of the present disclosure, which may be used in combination with each or any of the above-mentioned aspects, the titanium alloy exhibits an ultimate tensile strength (UTS) of at least 170 ksi at room temperature, and wherein the ultimate tensile strength and an elongation of the titanium alloy satisfy the equation: (7.5×Elongation in %)+UTS≥260.5.

In accordance with a twenty-fourth non-limiting aspect of the present disclosure, the present disclosure also provides a titanium alloy consisting essentially of, in weight percentages based on total alloy weight: 2.0 to 5.0 aluminum; 3.0 to 8.0 tin; 1.0 to 5.0 zirconium; 0 to a total of 16.0 of one or more elements selected from the group consisting of oxygen, vanadium, molybdenum, niobium, chromium, iron, copper, nitrogen, and carbon; titanium; and impurities.

In accordance with a twenty-fifth non-limiting aspect of the present disclosure, which may be used in combination with each or any of the above-mentioned aspects, a sum of vanadium and niobium contents in the alloy is, in weight percentages based on total alloy weight, 6.0 to 12, or 6.0 to 10.0.

In accordance with a twenty-sixth non-limiting aspect of the present disclosure, which may be used in combination with each or any of the above-mentioned aspects, a molybdenum content in the alloy is, in weight percentages based on total alloy weight, 0.1 to 5.0.

In accordance with a twenty-seventh non-limiting aspect of the present disclosure, which may be used in combination with each or any of the above-mentioned aspects, an aluminum equivalent value of the titanium alloy is 6.0 to 9.0.

In accordance with a twenty-eighth non-limiting aspect of the present disclosure, which may be used in combination with each or any of the above-mentioned aspects, a molybdenum equivalent value of the titanium alloy is 5.0 to 10.0.

In accordance with a twenty-ninth non-limiting aspect of the present disclosure, which may be used in combination with each or any of the above-mentioned aspects, an aluminum equivalent value of the titanium alloy is 6.0 to 9.0 and a molybdenum equivalent value of the titanium alloy is 5.0 to 10.0.

In accordance with a thirtieth non-limiting aspect of the present disclosure, which may be used in combination with each or any of the above-mentioned aspects, in the titanium alloy: a sum of vanadium and niobium contents is 6.0 to 12.0, or 6.0 to 10.0; a molybdenum content is 0.1 to 5.0; an iron content is 0.01 to 0.30; an oxygen content is 0.005 to 0.3; a carbon content is 0.001 to 0.07; and a nitrogen content is 0.001 to 0.03, all in weight percentages based on total weight of the titanium alloy.

In accordance with a thirty-first non-limiting aspect of the present disclosure, which may be used in combination with each or any of the above-mentioned aspects, a sum of aluminum, tin, and zirconium contents is, in weight percentages based on the total alloy weight, 8 to 15.

In accordance with a thirty-second non-limiting aspect of the present disclosure, which may be used in combination with each or any of the above-mentioned aspects, a ratio of the aluminum equivalent value to the molybdenum equivalent value of the titanium alloy is 0.6 to 1.3.

In accordance with a thirty-third non-limiting aspect of the present disclosure, a method of making a titanium alloy comprises: solution treating a titanium alloy at 760° C. to 840° C. for 2 to 4 hours; air cooling the titanium alloy to ambient temperature; aging the titanium alloy at 482° C. to 593° C. for 8 to 16 hours; and air cooling the titanium alloy, wherein the titanium alloy has the composition recited in each or any of the above-mentioned aspects.

In accordance with a thirty-fourth non-limiting aspect of the present disclosure, which may be used in combination with each or any of the above-mentioned aspects, the titanium alloy exhibits an ultimate tensile strength (UTS) of at least 170 ksi at room temperature, and wherein the ultimate tensile strength and an elongation of the titanium alloy satisfy the equation: (7.5×Elongation in %)+UTS≥260.5.

In accordance with a thirty-fifth non-limiting aspect of the present disclosure, a method of making a titanium alloy comprises: solution treating a titanium alloy at a temperature range from the alloy's beta transus minus 10° C. to the beta transus minus 100° C. for 2 to 4 hours; air cooling or fan air cooling the titanium alloy to ambient temperature; aging the titanium alloy at 482° C. to 593° C. for 8 to 16 hours; and air cooling the titanium alloy, wherein the titanium alloy has the composition recited in each or any of the above-mentioned aspects.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A titanium alloy comprising, in weight percentages based on total alloy weight:
6.0 to 12.0 vanadium;
3.0 to 8.0 tin;
2.0 to 5.0 aluminum;
1.0 to 5.0 zirconium;
1.0 to 5.0 molybdenum;
0.005 to 0.3 oxygen;
0 to 0.40 iron;
0 to 0.5 chromium;
0.001 to 0.05 carbon;
0 to 0.05 nitrogen;
titanium; and
impurities.

2. The titanium alloy of claim 1, comprising 8.6 to 11.4 vanadium in weight percent based on total alloy weight.

3. The titanium alloy of claim 1, comprising 8.6 to 9.4 vanadium in weight percent based on total alloy weight.

4. The titanium alloy of claim 1, comprising 4.6 to 7.4 tin in weight percent based on total alloy weight.

5. The titanium alloy of claim 1, comprising 2.0 to 3.9 aluminum in weight percent based on total alloy weight.

6. The titanium alloy of claim 1, comprising 3.0 to 3.9 aluminum in weight percent based on total alloy weight.

7. The titanium alloy of claim 1, comprising 2.0 to 3.4 aluminum in weight percent based on total alloy weight.

8. The titanium alloy of claim 1, comprising 1.6 to 3.4 zirconium in weight percent based on total alloy weight.

9. The titanium alloy of claim 1, comprising 1.0 to 3.0 molybdenum in weight percent based on total alloy weight.

10. The titanium alloy of claim 1, comprising 2.0 to 3.0 molybdenum in weight percent based on total alloy weight.

11. The titanium alloy of claim 1, comprising 0.005 to 0.25 oxygen in weight percent based on total alloy weight.

12. The titanium alloy of claim 1, comprising 0.01 to 0.40 iron in weight percent based on total alloy weight.

13. The titanium alloy of claim 1, further comprising niobium, wherein the niobium and vanadium together comprise greater than 6.0 to 12.0 weight percent based on total alloy weight.

14. The titanium alloy of claim 1, comprising, in weight percentages based on total alloy weight:
8.6 to 11.4 vanadium;
4.6 to 7.4 tin;
2.0 to 3.9 aluminum;
1.6 to 3.4 zirconium;
2.0 to 3.0 molybdenum;
0.005 to 0.3 oxygen;
0.01 to 0.4 iron;

0 to 0.5 chromium;
0.001 to 0.05 carbon;
0.001 to 0.03 nitrogen;
titanium; and
impurities.

15. The titanium alloy of claim 1, comprising an aluminum equivalent value of 6.0 to 9.0, and a molybdenum equivalent value of 5.0 to 10.0.

16. The titanium alloy of claim 1, comprising an aluminum equivalent value of 7.0 to 8.0, and a molybdenum equivalent value of 6.0 to 7.0.

17. The titanium alloy of claim 1, wherein a ratio of aluminum equivalent value to molybdenum equivalent value is 0.6 to 1.3.

18. The titanium alloy of claim 1, wherein the titanium alloy exhibits, at room temperature, an ultimate tensile strength of at least 170 ksi and an elongation of at least 6%.

19. The titanium alloy of claim 1, wherein the titanium alloy exhibits, at room temperature, an ultimate tensile strength of at least 180 ksi and an elongation of at least 6%.

20. A titanium alloy consisting of, in weight percentages based on total alloy weight:
6.0 to 12.0 vanadium;
3.0 to 8.0 tin;
2.0 to 5.0 aluminum;
1.0 to 5.0 zirconium;
1.0 to 5.0 molybdenum;
0.005 to 0.3 oxygen;
0 to 0.40 iron;
0 to 0.5 chromium;
0.001 to 0.05 carbon;
0 to 0.05 nitrogen;
titanium; and
impurities.

21. A titanium alloy comprising, in weight percentages based on total alloy weight:
one or more of vanadium and niobium, wherein a total content of vanadium and niobium is 8.6 to 11.4;
4.6 to 7.4 tin;
2.0 to 3.9 aluminum;
1.0 to 3.0 molybdenum;
1.6 to 3.4 zirconium;
0 to 0.5 chromium;
0 to 0.4 iron;
0 to 0.25 oxygen;
0 to 0.05 nitrogen;
0.001 to 0.05 carbon;
titanium; and
impurities.

22. The titanium alloy of claim 21, wherein a total content of vanadium and niobium is 8.6 to 9.4 in weight percent based on total alloy weight.

23. The titanium alloy of claim 21, wherein a total content of vanadium and niobium is 10.6 to 11.4 in weight percent based on total alloy weight.

24. The titanium alloy of claim 21 comprising, 2.0 to 3.0 molybdenum in weight percent based on total alloy weight.

25. The titanium alloy of claim 21 comprising 1.0 to 2.0 molybdenum in weight percent based on total alloy weight.

26. The titanium alloy of claim 21, wherein the titanium alloy comprises an aluminum equivalent value of 7.0 to 8.0.

27. The titanium alloy of claim 21, wherein the titanium alloy comprises a molybdenum equivalent value of 6.0 to 7.0.

28. The titanium alloy of claim 21 consisting of, in weight percentages based on total alloy weight:
one or more of vanadium and niobium, wherein a total content of vanadium and niobium is 8.6 to 11.4;
4.6 to 7.4 tin;
2.0 to 3.9 aluminum;
1.0 to 3.0 molybdenum;
1.6 to 3.4 zirconium;
0 to 0.5 chromium;
0 to 0.4 iron;
0 to 0.25 oxygen;
0 to 0.05 nitrogen;
0.001 to 0.05 carbon;
titanium; and
impurities.

29. The titanium alloy of claim 28, wherein an aluminum equivalent value of the titanium alloy 7.0 to 8.0.

30. The titanium alloy of claim 28, wherein a molybdenum equivalent value of the titanium alloy is 6.0 to 7.0.

31. The titanium alloy of claim 28, wherein an aluminum equivalent value of the titanium alloy 7.0 to 8.0 and a molybdenum equivalent value of the titanium alloy is 6.0 to 7.0.

* * * * *